United States Patent [19]

Giard

[11] 4,422,269

[45] Dec. 27, 1983

[54] MASONRY PRODUCT

[76] Inventor: Robert L. Giard, High Road, Gilbertville, Mass. 01031

[21] Appl. No.: 255,320

[22] Filed: Apr. 17, 1981

[51] Int. Cl.[2] ..... E04B 1/20

[52] U.S. Cl. ..... 52/100; 52/301; 52/314; 52/296

[58] Field of Search ..... 52/296, 297, 301, 98, 52/103, 100, 600, 601, 722, 314, 100; 256/49-51; 174/45 R; 363/414, 431

[56] References Cited

U.S. PATENT DOCUMENTS

| | | | |
|---|---|---|---|
| 750,256 | 1/1904 | Campbell | 256/49 |
| 841,532 | 1/1907 | Jones | 52/301 |
| 891,246 | 6/1908 | Grissom | 256/50 |
| 958,619 | 5/1910 | Frazier | 256/50 |
| 1,001,603 | 8/1911 | Aschauer et al. | 52/722 |
| 1,204,187 | 11/1916 | Pickrell | 256/49 |
| 1,700,504 | 1/1929 | Mahan | 52/124.2 |
| 1,708,790 | 11/1927 | Hall . | |
| 1,905,856 | 4/1933 | Haase et al. | 52/100 |
| 2,188,419 | 1/1940 | Saviteer | 52/103 |
| 3,695,574 | 9/1970 | Charlier . | |
| 4,262,951 | 4/1981 | Hoyer | 53/125.4 |

FOREIGN PATENT DOCUMENTS

| | | | |
|---|---|---|---|
| 448867 | 6/1936 | United Kingdom | 52/315 |
| 784749 | 10/1957 | United Kingdom | 363/431 |

*Primary Examiner*—James L. Ridgill, Jr.
*Attorney, Agent, or Firm*—Blodgett & Blodgett

[57] ABSTRACT

A concrete core for masonry having an upper portion with vertical surfaces on a flat top surface and a lower base portion which forms a supporting shelf about the bottom periphery of the upper portion. The invention also includes a finished masonry structure having a plurality of masonry elements supported on the ledge of the core and covering the horizontal surfaces of the upper portion of the core.

10 Claims, 9 Drawing Figures

MASONRY PRODUCT

BACKGROUND OF THE INVENTION

This invention relates generally to masonry products and, more particularly, to decorative pillars and to cores for constructing masonry products.

Masonry products of the pillar-type are widely used by homeowners and businesses for a variety of purposes such as the posts at the entrance of a driveway, as a flowerstand, as a base for a statue, and at the bottom of outside steps. The construction of decorative pillars normally requires the services of a skilled mason or the possession of specialized masonry tools. The average individual does not usually have the required tools or skill for constructing appropriate concrete forms or for completing decorative pillar construction. As a result, most decorative masonry items are usually purchased or built by a hired artisan. Purchased items have the disadvantage of limited selection. This disadvantage is avoided by hiring an artisan in masonry to construct the masonry item, but the item is likely to cost a great deal more. These and other difficulties experienced with the prior art devices have been obviated by the present invention.

It is, therefore, an outstanding object of the invention to provide a concrete core which enables an individual with a minimum of skill and tools to construct a decorative masonry product.

Another object of this invention is the provision of a concrete core which enables a wide variety of masonry products to be constructed.

A further object of the present invention is the provision of a concrete core which may be used to construct a masonry product from a variety of masonry materials such as stone, brick, ceramic, or synthetic masonry materials made from plastics.

It is another object of the instant invention to provide a concrete core which enables a person to construct a finished masonry product to suit the individual's taste.

It is a further object of the invention to provide a concrete core having means to enable a lighting fixture to be applied to the finished masonry product.

It is a further object of the invention to provide a concrete core which can be used to produce a unique and attractive finished masonry product.

It is a further object to provide a decorative masonry product which makes use of a preformed core.

With these and other objects in view, as will be apparent to those skilled in the art, the invention resides in the combination of parts set forth in the specification and covered by the claims appended hereto.

SUMMARY OF THE INVENTION

In general, the invention consists of a concrete core for masonry having an upper portion with a plurality of vertical surfaces and a flat horizontal top surface and having a lower base portion that is integral with the upper portion. The lower base portion extends outwardly of the upper portion to form a horizontal ledge about the entire lower periphery of the upper portion. The invention also consists of a masonry structure which utilizes the above-described core and includes a plurality of masonry elements supported on the ledge and covering the surfaces of the core.

More specifically, the core also includes a flat concrete cover having a hole in its undersurface that extends only part way through the thickness of the cover, so that the remaining material above the hole can be easily removed for the installation of an electrical lighting fixture. The core also includes an anchor bolt embedded in the upper portion of the core; the upper portion of the anchor bolt has a hooking element that extends into a depression in the top surface of the core. The core is also provided with an electrical conduit that extends from the depression to an outer surface in the base at a point below the ledge.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
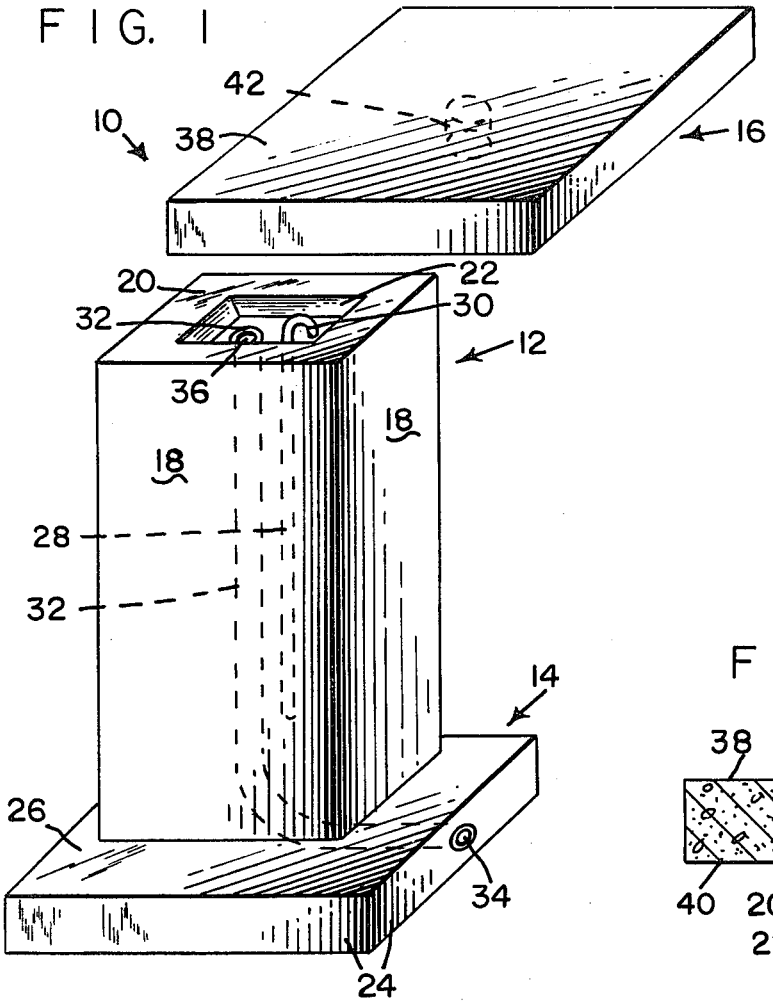
FIG. 1 is an exploded perspective view of the concrete core, including the cover, embodying the principles of the present invention.
Figure 3:
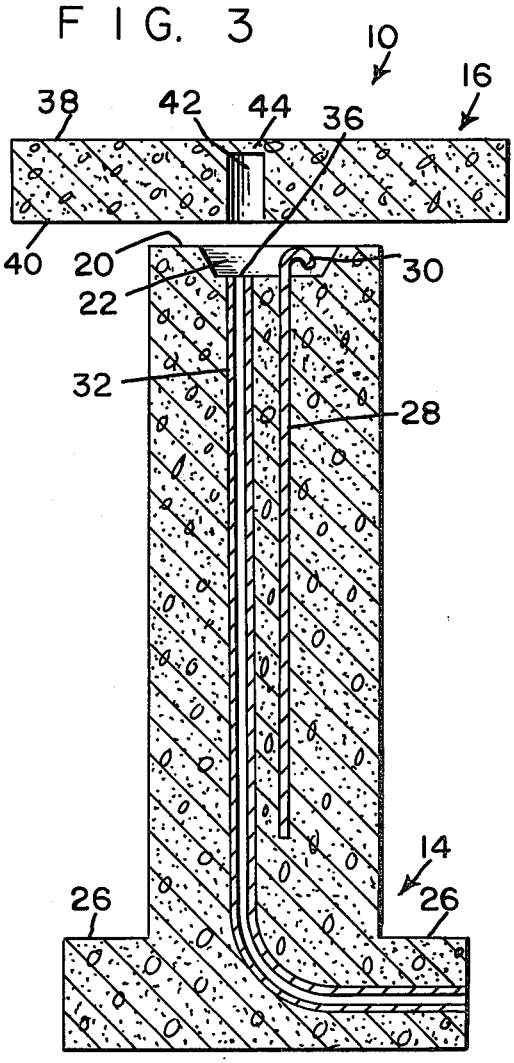
FIG. 3 is a vertical sectional view of the core, taken along the line III—III of FIG. 2.
Figure 2:
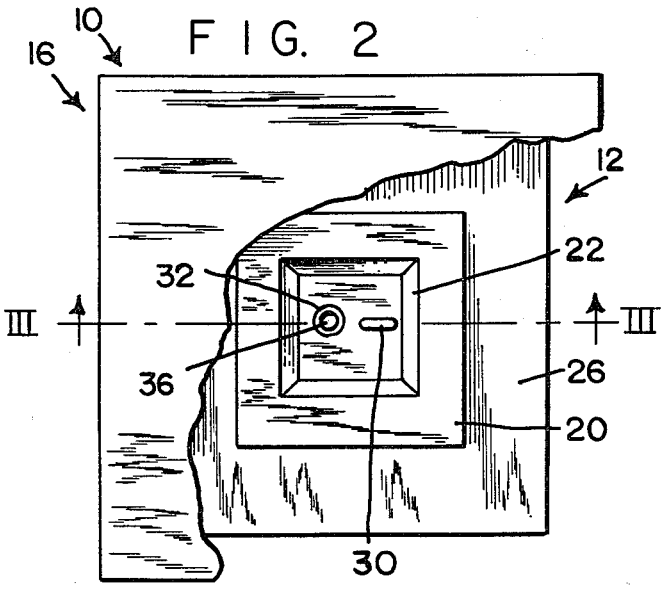
FIG. 2 is a plan view of the core with portions of the cover broken away.

Referring first to FIGS. 1, 2, and 3, which best show the general features of the invention, the cement core is indicated generally by the reference numeral 10. The core 10 comprises an upper portion 12, a lower base portion 14, and a flat cover 16.

The upper portion 12 of the core is a polyhedren with flat vertical surfaces 18 and a flat horizontal top surface 20 which is provided with a central depression 22. The upper portion 12 is preferably rectangular in horizontal cross section. This is the shape that is most commonly desired and is the easiest to work with when the core is used to construct a finished masonry product. The lower base portion 14 extends laterally of the upper portion 12 and has a plurality of flat vertical surfaces 24 and a flat upper horizontal surface 26. The vertical surfaces 24 are equal in number to the horizontal surfaces 18 of the upper portion 12 and are spaced from and parallel with the surfaces 18. The flat horizontal surface 26 extends around the entire bottom periphery of the surfaces 18 and forms a ledge with respect to the upper portion 12.

An anchor rod 28 is imbedded in the upper portion 12 and has a protuberance 30 that is shown in the form of a hook in FIG. 3. The rod 28 is constructed of a material having high tensile strength, such as steel, which allows the form to be lifted by a hoisting mechanism for transporting the form from one location to another. The cable of the hoisting mechanism is attached to the hook or protuberance 30 and the form is lifted onto a truck or other transporting device.

The upper portion 12 is also provided with an electrical conduit 32 that extends through the interior of the form. The conduit 32 has an inlet opening 34 in one of the surfaces 24 of the lower base portion and an outlet opening 36 at the bottom of depression 22. The cover 16 has an upper flat surface 38 and a lower flat surface 40. An opening 42 extends from the lower surface 40 toward the upper surface 38, but stops short of surface 38, this leaving a thin layer 44 of the material just above the hole 42. When the cover 16 is placed on top of the upper portion 12, the hole 42 is vertically aligned with the outlet opening 36 of the electrical conduit. If it is desired to add a lighting fixture to the finished masonry product, the thin layer 44 of the cover is punched through. This allows a lighting fixture to be inserted into the hole 42 from above and connected to an electrical cable that has been threaded through the conduit 32.

Figure 5:
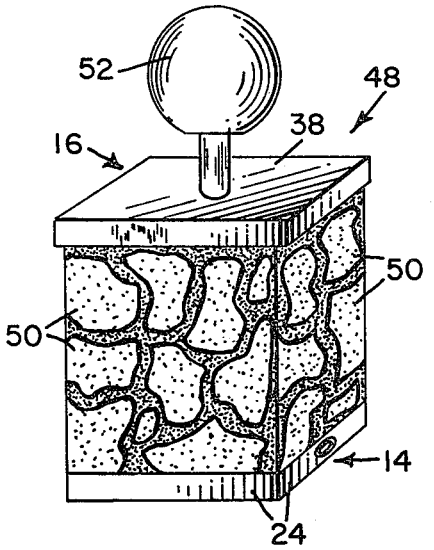
FIG. 5 is a perspective view of a finished masonry product embodying the principles of the present invention.
Figure 7:
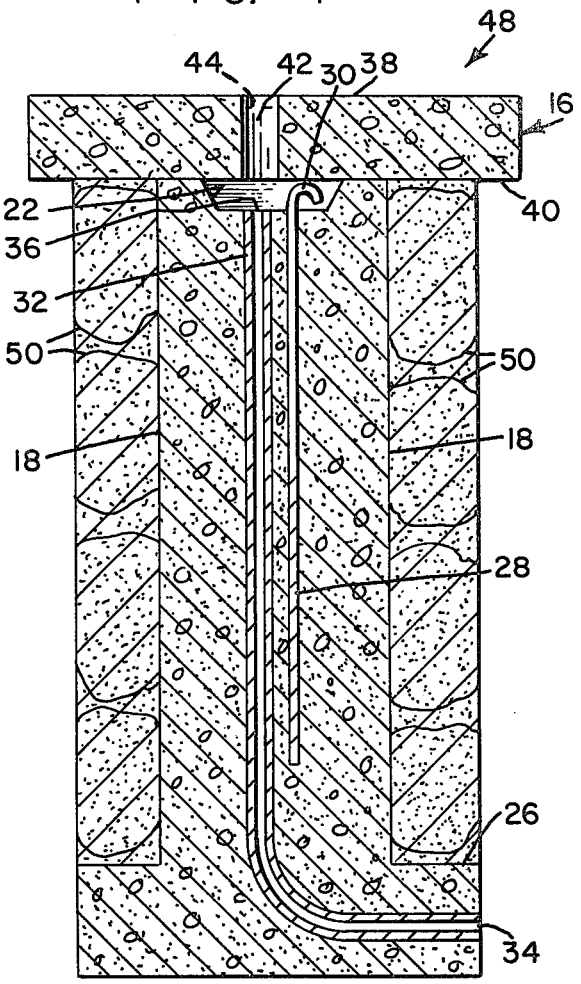
FIG. 7 is a vertical sectional view of the masonry product taken on the line VII—VII of FIG. 6.
Figure 6:
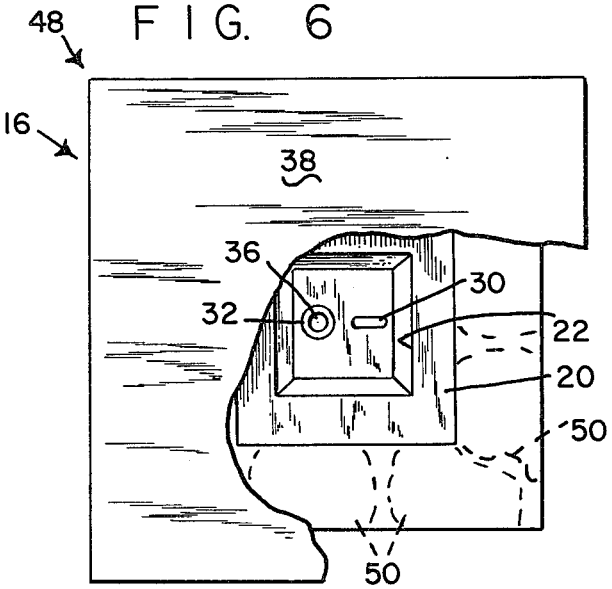
FIG. 6 is a plan view of the masonry product.
Figure 4:
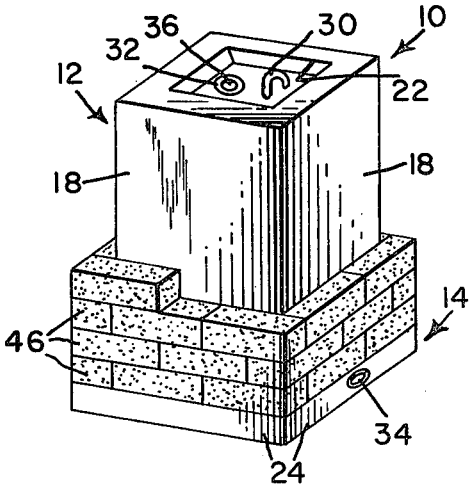
FIG. 4 is a perspective view of a partially completed masonry product utilizing the core.

The utilization of the cement core described above for construction of a finished masonry product is illustrated in FIGS. 4–7. FIG. 4 illustrates a partially-completed decorative masonry product, showing the flat vertical surfaces 18 partially covered by masonry elements in the form of bricks 46. In constructing the finished masonry product, the decorative masonry elements, such as the bricks 46, are first laid on the upper surface or shelf 26. Additional masonry elements are then applied until the surfaces 18 are completely covered. As shown in FIG. 4, several courses of bricks 46 have been laid. FIG. 5 shows a completed masonry structure in which the surfaces 18 are completely covered by a decorative masonry material, shown in FIG. 5 as field stone 50 imbedded in mortar. FIG. 5 also shows a lighting fixture 52 applied to the top of the masonry structure 48. As shown in FIG. 7, the thin layer of material 44 above the opening 42 has been punched out, so that hole 42 extends completely through the cover 16 to allow insertion of the lighting fixture 52.

Figure 8:
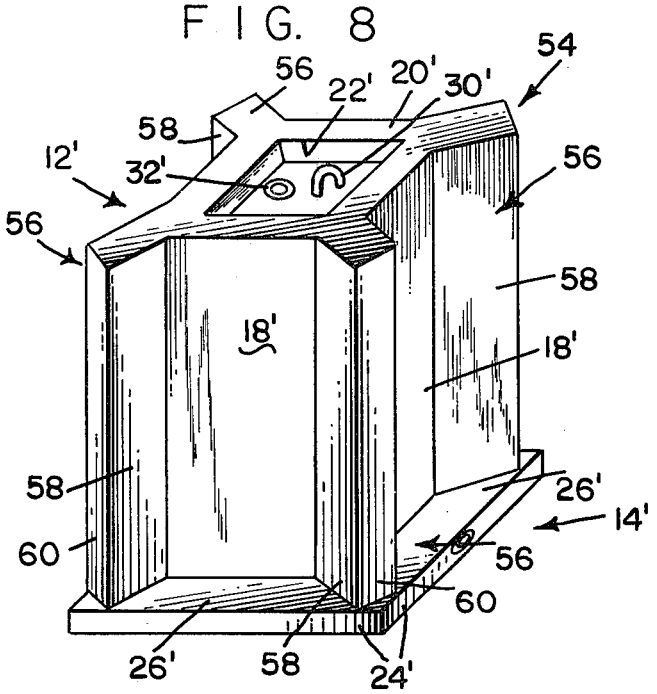
FIG. 8 is a perspective view of an alternative form of the core.
Figure 9:
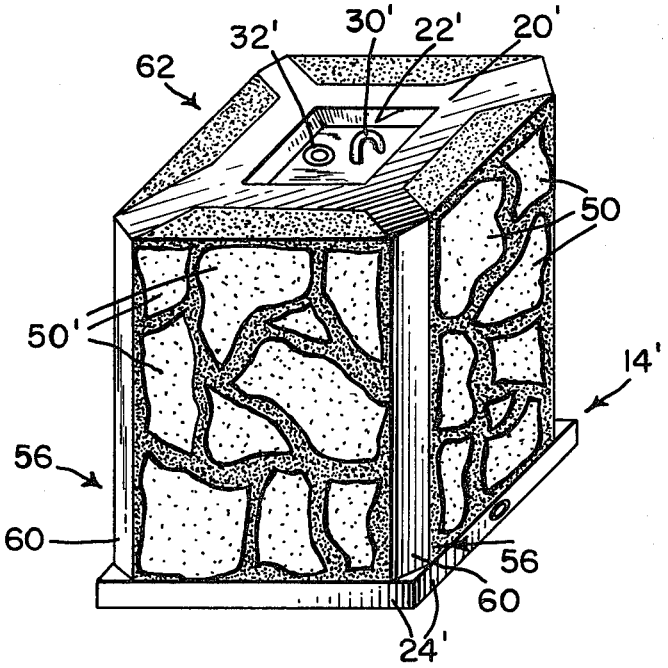
FIG. 9 is a perspective view of a finished masonry product utilizing the core of FIG. 8.

Referring now to FIG. 8, a modified form of the core, generally indicated by the reference numeral 54, is shown. The core consists of an upper portion 12' and a lower base portion 14'. The upper portion 12' has a plurality of flat vertical surfaces 18' and a flat horizontal surface 20'. The lower base portion 14' has a plurality of vertical surfaces 24' which are spaced from and parallel with surfaces 18' and a flat horizontal surface or ledge 26'. The form 54 is identical to the form 10, shown in FIG. 1, except that it includes a vertical rib 56 at each of the corners that are formed by adjacent surfaces 18'. Each rib 56 extends from the ledge 26' to the top surface 20'. When the form 54 is used to construct a finished masonry product, the masonry elements are built up from the ledge 26' in the same manner as shown in FIG. 4, except that the masonry elements extend between the ribs 56. As shown in FIG. 9, the vertical side surfaces 58 of the ribs and the vertical surfaces 18' of the upper portion are covered, leaving only the vertical end surfaces 60 of the ribs exposed to form a decorative bead. The decorative masonry material extending between the ribs 56, as shown in FIG. 9, is fieldstone 50' set in mortar.

It is apparent from the above description that each of the forms 10 and 54, as shown in the drawings, can be used to construct a variety of decorative masonry products which can be constructed very easily with a minimum of skill and specialized tools. The core provides a basic uniform supporting structure that enables two or more finished masonry products to be constructed with a high degree of accuracy and uniformity. This is particularly important when building a set of pillars for a driveway or steps leading into a house. Since the forms can be produced and sold in standard sizes and since any available masonry material such as bricks, stone, etc. can be used to complete the masonry structure, the total cost of the completed structure can be substantially less than the cost of a purchased structure or the cost of having such a structure built without the form. In addition, the individual who completes the masonry structure from the form of the present invention is likely to have a sense of personal pride since his or her contribution resides in the aspect of the structure that is most visible and artistic.

It is obvious that minor changes may be made in the form and construction of the invention without departing from the material spirit thereof. It is not, however, desired to confine the invention to the exact forms herein shown and described, but it is desired to include all such as properly come within the scope claimed.

The invention having been thus described, what is claimed as new and desired to secure by Letters Patent is:

1. A concrete core for masonry, comprising:

(a) an upper portion in the shape of a polyhedren having a plurality of vertical surfaces and a flat horizontal top suface, (b) a lower base portion integral with the upper portion and having larger horizontal dimensions than the upper portion, so that a horizontal ledge is formed about the entire lower periphery of the upper portion, (c) a conduit for electrical wire extending through the core and having an inlet opening at the base and an outlet opening at the horizontal top surface, and (d) a flat cover having an upper and lower flat surfaces which are substantially larger than said horizontal top surface said lower flat surface having a hole which extends upwardly to a point just beneath the upper surface so as to form a relatively thin layer of material just above the hole, said cover being adapted to rest on said horizontal top surface and said hole being located so that it overlies the outlet opening of said conduit when said cover is centrally located on said top surface.

2. A concrete core as recited in claim 1, comprising an anchor element constructed of a material having relatively high tensile strength embedded in said upper portion, the top of said anchor element having an exposed hooking protuberance adjacent the said top horizontal surface.

3. A concrete core as recited in claim 2, wherein said horizontal top surface has a depression and said protuberance extends into said depression and lies below said top surface.

4. A concrete core as recited in claim 1, wherein the lower base portion has the same number of vertical surfaces as the upper portion, the vertical surfaces of the lower base portion being spaced from and parallel with the vertical surfaces of the upper portion.

5. A concrete core as recited in claim 4, wherein the upper and lower portions are each rectangular in horizontal cross-section.

6. A concrete core as recited in claim 5, comprising a vertical rib along each vertical corner of the upper portion that extends from the base to the top horizontal surface.

7. A masonry structure comprising:

(a) a concrete core which is rectangular in horizontal cross-section and having four surfaces, a flat horizontal top surface and a horizontal ledge extending about the lower periphery of said vertical surfaces, (b) a vertical rib along each vertical corner of said vertical surfaces, that extends from the ledge to the top horizontal surface, (c) a plurality of masonry elements supported on the ledge and covering the ledge and vertical surfaces of the core between said ribs, and (d) a flat horizontal cover that rests on the top surface and overlies the masonry elements.

8. A masonry structure as recited in claim 7, comprising:

(a) a depression in the horizontal top surface, and (b) an anchor element constructed of a material having relatively high tensile strength embedded in the core, the upper portion of the anchor element having a hooking protuberance which extends into the depression so that said protuberance is exposed for engagement by hoisting means and lies below the horizontal top surface and beneath the cover.

9. A masonry structure as recited in claim 7, comprising a conduit for electrical wire extending through the core, said conduit having an inlet opening below the ledge and an outlet opening at the horizontal top surface.

10. A masonry structure as recited in claim 9, wherein the cover has a hole which is vertically aligned with the outlet opening of the conduit.

* * * * *